US008625395B2

(12) United States Patent
Goeller et al.

(10) Patent No.: US 8,625,395 B2
(45) Date of Patent: Jan. 7, 2014

(54) STRIKING MECHANISM WITH DISTINCT STRIKES

(75) Inventors: Eric Goeller, Les Hopitaux-Vieux (FR); Jean Remont, Les Rousses (FR)

(73) Assignee: Montres Breguet S.A., L'Abbaye (CH)

( * ) Notice: Subject to any disclaimer, the term of this patent is extended or adjusted under 35 U.S.C. 154(b) by 88 days.

(21) Appl. No.: 13/413,048

(22) Filed: Mar. 6, 2012

(65) Prior Publication Data

US 2012/0230163 A1 Sep. 13, 2012

(30) Foreign Application Priority Data

Mar. 8, 2011 (EP) ..... 11157267

(51) Int. Cl.
*G04B 21/00* (2006.01)

(52) U.S. Cl.
USPC ..... 368/267

(58) Field of Classification Search
USPC ..... 368/260, 267–271, 98, 315, 243, 244
See application file for complete search history.

(56) References Cited

U.S. PATENT DOCUMENTS

| | | | | |
|---|---|---|---|---|
| 7,021,819 | B2 * | 4/2006 | Schmiedchen | 368/147 |
| 7,322,742 | B2 * | 1/2008 | Goeller | 368/147 |
| 7,420,882 | B2 * | 9/2008 | Goeller | 368/75 |
| 2008/0008052 | A1 | 1/2008 | Moteki | |

FOREIGN PATENT DOCUMENTS

| | | |
|---|---|---|
| CH | 633 376 | 8/1977 |
| CH | 689 337 A5 | 2/1999 |
| EP | 1 429 214 B1 | 8/2005 |
| EP | 1 879 086 61 | 5/2010 |
| EP | 1 770 453 B1 | 10/2011 |

OTHER PUBLICATIONS

European Search Report issued on Sep. 7, 2011 in corresponding European Application No. 11 15 7267 filed on Mar. 8, 2011 (with an English Translation).
U.S. Appl. No. 13/357,967, filed Jan. 25, 2012, Goeller.
U.S. Appl. No. 13/413,299, filed Mar. 6, 2012, Goeller.
U.S. Appl. No. 13/413,214, filed Mar. 6, 2012, Goeller.

* cited by examiner

*Primary Examiner* — Edwin A. Leon
(74) *Attorney, Agent, or Firm* — Oblon, Spivak, McClelland, Maier & Neustadt, L.L.P.

(57) ABSTRACT

Striking mechanism unit for a repeater striking mechanism, including a drive plate with a pipe pivoting about an axis and carrying a hook provided with a beak, a detent ratchet pivoting about the axis carrying a pin which is in abutment, through a hole in the plate, on the hook against a spring for the operation thereof when the detent ratchet is pivoting, and depending on the position thereof, the beak allows or prevents the pivoting of a pipe ratchet of a downstream stage which pivots integrally with a first hour ratchet. The downstream stage includes a second hour ratchet which pivots about the axis and whose toothing is inclined in the same direction as that of the first hour ratchet.

19 Claims, 6 Drawing Sheets

54
D2
55
58
116
D
113
23
21
112
115
110
111
2
9
1
109
10
105
100
107
101
104
103
103A
102
111
5
15
19
111
3
22
56
57
AC
106
117
108
54
57
55
56
54
D2
57
56
55
110

STRIKING MECHANISM WITH DISTINCT STRIKES

This application claims priority from European Patent Application No. 11157267.3 filed Mar. 8, 2011, the entire disclosure of which is incorporated herein by reference.

FIELD OF THE INVENTION

The invention concerns a striking mechanism unit for a timepiece repeater striking mechanism, said unit including a drive plate with a pipe pivotally mounted about a pivot axis, said drive plate carrying a click comprising a hook provided with a beak, which is returned towards said axis by a spring, said unit further including a detent ratchet pivoting about said axis and carrying a pin which is in abutment, through a hole in said drive plate, on said click against said spring to operate said hook when said detent ratchet pivots, and said beak of said hook, depending upon the position thereof, allowing or preventing the pivoting of a pipe ratchet comprised in a downstream stage, said pipe ratchet being mounted to pivot coaxially on said pipe and also to pivot integrally about said axis with a first hour ratchet.

The invention also concerns a repeater striking mechanism including a striking mechanism unit of this type.

The invention also concerns a timepiece including at least one timepiece movement and at least one striking mechanism of this type.

The invention concerns the field of horology, and more specifically the field of timepieces including striking mechanisms, particularly repeaters.

BACKGROUND OF THE INVENTION

Repeater strike mechanisms are exceptional timepieces, as regards their large number of components and the care and time required for fabrication and assembly operations. Striking mechanism complications have been known since at least the XVIII century, but have only been the subject of a limited number of publications between 1763 and the middle of the XX century. The reference work well known to the practitioner of complications, in particular grand strikes and repeaters, to which reference will be made to avoid overloading the explanation of the invention, is the work "Les montres compliquées" (Complicated watches) by Francois Lecoultre and edited by Editions Horlogères in Bienne.

EP Patent Application No. 1 429 214 A1 in the name of ROTH & GENTA HAUTE HORLOGERIE discloses a mechanism which prevents activation of the time setting mechanism while a striking mechanism is playing, with a means of locking the time-setting lever connecting said lever to a movable part of the striking mechanism, which can be moved between a rest position and an operating position. This locking means locks the lever as soon as the movable part is moved away from its rest position. This mechanism includes a pipe ratchet, an hour ratchet and a detent ratchet, in addition to a toothed sector, which is intended to mesh with the quarter-rack, arranged to pivot freely and can be driven by a finger. This sector and the rack pinion are released after the striking mechanism has been started.

CH Patent Application No. 689 337 A5 in the name of PATEK PHILIPPE SA discloses a chiming timepiece playing different tunes at each of the quarters, with four quarter-racks and four quarter-cams. The timepiece includes a pipe ratchet, an hour ratchet and a detent ratchet.

EP Patent Application No. 1 879 086 A1 in the name of SEIKO EPSON CORP discloses a striking watch with a drive ratchet, a detent ratchet and a single hour ratchet.

EP Patent Application No. 1 770 453 A1 in the name of CHRISTOPHE CLARET presents a dual striking mechanism, for producing a choice of strikes corresponding to two time zones.

CH Patent No. 633 376 D in the name of DUBOIS & DEPRAZ discloses a repeater watch wherein the mechanism is entirely carried by an independent frame fixed to the movement plate.

SUMMARY OF THE INVENTION

The invention proposes to go beyond the state of the art by proposing a timepiece allowing varied strikes or sounds to be played according to different circumstances, for example which are different in the morning and afternoon, or night and day, or for first and second time zones.

The invention therefore concerns a striking mechanism unit for a timepiece repeater striking mechanism, said unit including a drive plate with a pipe pivotally mounted about a pivot axis, said drive plate carrying a click comprising a hook provided with a beak which is returned towards said axis by a spring, said unit further including a detent ratchet pivoting about said axis and carrying a pin which is in abutment, through a hole in said drive plate, on said click against said spring to operate said hook when said detent ratchet pivots, and said beak of said hook, depending on the position thereof, allowing or preventing the pivoting of a pipe ratchet, comprised in a downstream stage, said pipe ratchet being mounted to pivot coaxially on said pipe and also to pivot integrally about said axis with a first hour ratchet, characterized in that said pivoting downstream stage further includes at least a second hour ratchet pivoting about said axis, the toothing of said second hour ratchet being inclined in the same direction as the toothing of said first hour ratchet.

The invention further concerns a repeater striking mechanism, comprising a striking mechanism unit of this type, characterized in that it further includes, on the one hand a first lifting piece driving a first hammer cooperating with said first hour ratchet, and on the other hand, a second lifting piece driving a second hammer and distinct from said first lifting and drive piece and cooperating with said at least one second hour ratchet, and in that it includes a striking mechanism control mechanism controlling the pivoting of said striking mechanism unit by operating said hook.

The invention further concerns a timepiece including at least one timepiece movement and at least one striking mechanism of this type, wherein said timepiece movement controls said striking mechanism.

BRIEF DESCRIPTION OF THE DRAWINGS

Other features and advantages of the invention will appear more clearly upon reading the following detailed description, with reference to the annexed drawings, in which.

DETAILED DESCRIPTION OF PREFERRED EMBODIMENTS

The invention concerns the field of horology, and more specifically the field of timepieces including repeater striking mechanisms.

Figure 1:
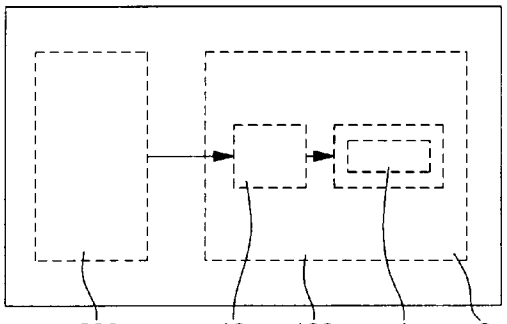
FIG. 1 shows a schematic, block diagram of a timepiece comprising a timepiece mechanism, a repeater striking mechanism, a striking mechanism unit and a downstream stage of a striking mechanism unit according to the invention.

FIG. 1 illustrates the composition of a complicated timepiece 1000, particularly a watch. This timepiece 1000 includes, in a conventional manner, a timepiece movement 200 controlling a repeater striking mechanism 100. Said repeater striking mechanism includes a striking mechanism control mechanism interfaced with the timepiece movement 200.

Figures 2, 23, 24:
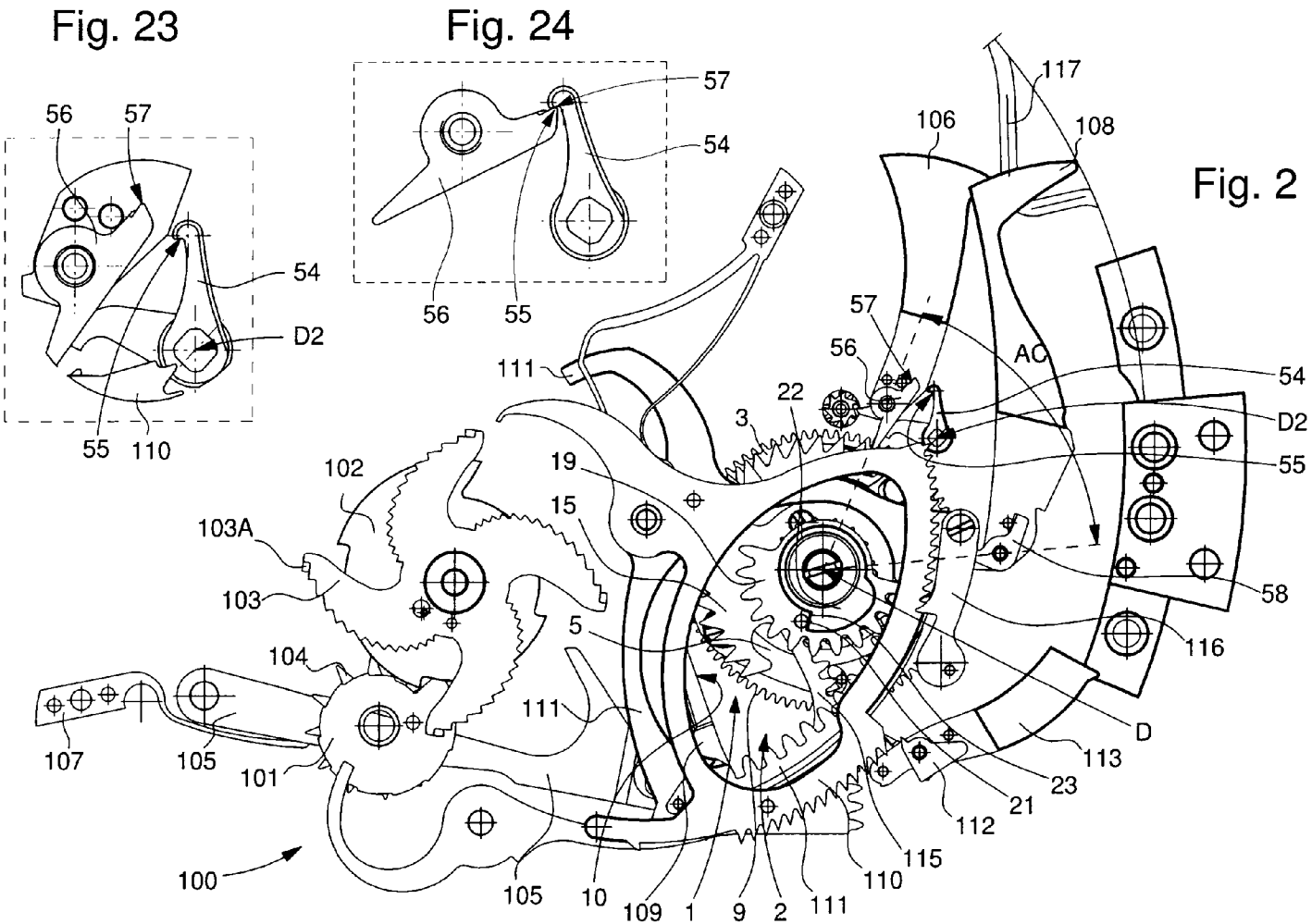
FIG. 2 shows a schematic partial view of a repeater striking mechanism including a striking mechanism unit and a downstream stage of a striking mechanism unit according to the invention.
FIG. 23 shows a schematic, plan, bottom view of the feeler spindle of FIG. 22 opposite a hammer lifting piece comprised in the repeater striking mechanism of FIG. 2, in a position for allowing said lifting piece to pivot.
FIG. 24 shows, in a similar manner to FIG. 23, the feeler spindle in a position for locking said lifting piece.
Figure 5:
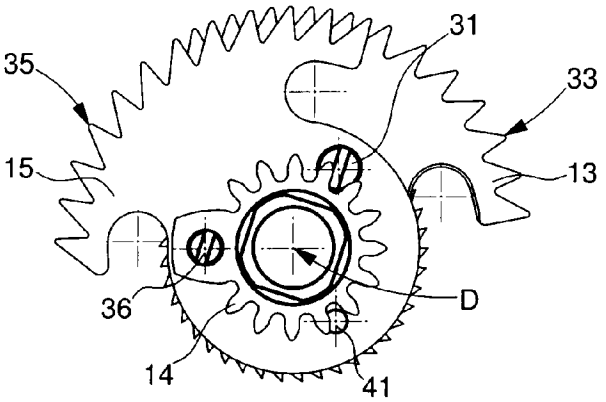
FIG. 5 shows a schematic plan view of the downstream stage of FIG. 4.
Figure 6:
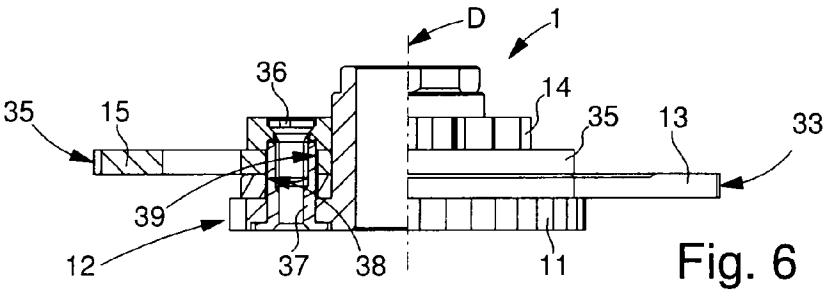
FIGS. 6 and 7 show schematic cross-sections respectively along plane AA and plane BB of the timepiece of FIG. 5.
Figure 7:
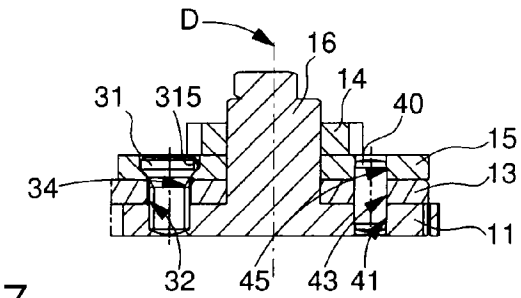
Figure 11:
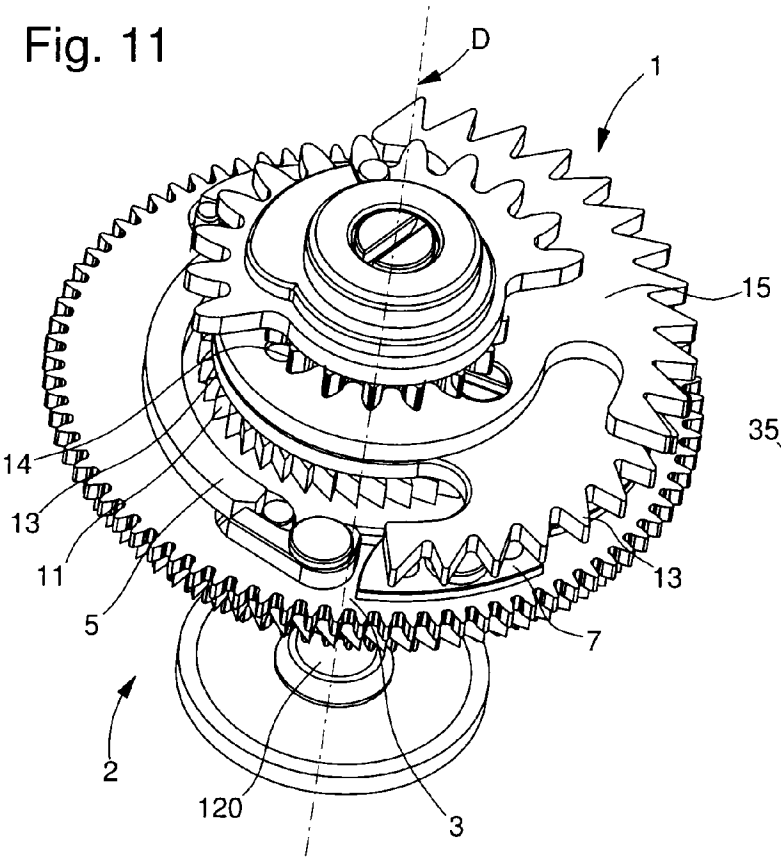
FIG. 11 shows a schematic, perspective view of the fusee module of FIG. 3 assembled and cooperating with a drive arbour.
Figure 13:
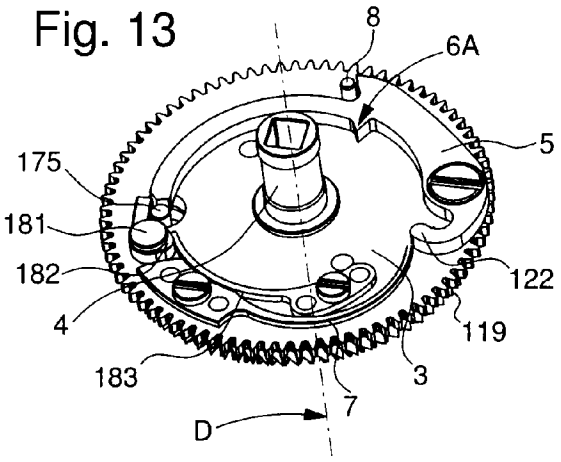
FIG. 13 shows a schematic, perspective view of a drive pate, fitted with a click having a hook with a beak, and with a spring, comprised in the striking mechanism unit of FIG. 3, said click shown cooperating with a pin comprised in a detent ratchet also belonging to said striking mechanism unit, said drive plate being assembled with said detent ratchet and a wheel also comprised in said striking mechanism unit.

FIG. 2 partially shows a repeater striking mechanism 100 according to the invention. The conventional components of a grand strike or repeater striking mechanism, in particular a minute repeater, are not all shown, since those skilled in the art may refer to the aforecited work "Les montres compliquées" to find the usual combinations.

FIG. 2 shows the information gathering members of the striking mechanism: the hour snail 101, quarter snail 102 and minute snail 103 with the surprise 103A. A release lever 105 is shown with its spring 107 and with a click 109 intended to cooperate with a detent ratchet 9, which will be presented hereinafter. The minute-rack 110 and quarter-rack 111 are visible, in addition to, for striking the hours, a first lifting piece 58 driving a first hammer 108 against a gong (not shown in the Figures), located underneath gong 117, which is the only one shown to avoid overloading the Figure, and a second lifting piece 56 for driving a second hammer 106 which cooperates with said gong 117. For striking the minutes a lifting piece 112 drives a small hammer 113. A rack 115 for winding the striking mechanism is partially visible. It is intended to cooperate with a rack pinion 14 which will be presented hereinafter. A minute hook 116 is fixed to the quarter-rack 111 to limit the striking mechanism according the number of minutes and quarters to be struck, to prevent the mechanism from rotating idly between the quarters and minutes. The minute-rack 110 thus always stops in the same rest position.

A striking mechanism 100 includes a drive means, which is preferably distinct from that of the actual timepiece movement 200. This drive means is not described in detail here. It may take the form of a barrel, a spring or similar, in general powered by the action of the user on a rack push piece or similar. This drive means provides the energy necessary to operate the strike or strikes. It is represented here simply by a drive arbour 120 transmitting energy to the sound generating wheel sets of the striking mechanisms.

In a conventional manner, this drive arbour 120 sets in motion a striking mechanism unit 2. The present invention concerns more specifically a particular arrangement of this unit 2 which allows new functions to be created. More specifically, the invention concerns a downstream stage 1 of said unit 2, which is the stage the furthest downstream from said striking mechanism unit 2, i.e. the stage which communicates energy straight to one or more hammer lifting pieces 58, 56 comprised in striking mechanism 100, to actuate the strike of one or several hammers on gongs 117, bells or similar.

Figure 3:
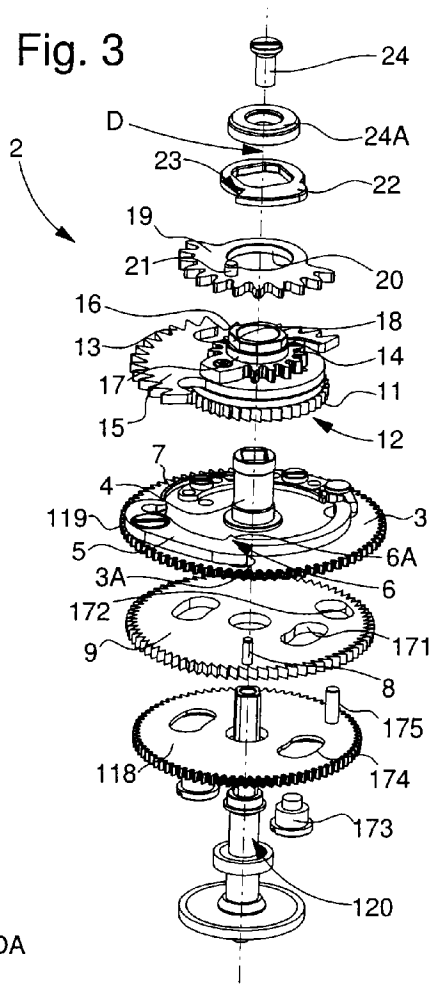
FIG. 3 shows a schematic, partial and exploded view of a striking mechanism unit comprising a downstream stage according to the invention.

The striking mechanism unit 2 seen in FIG. 3 and described here is of the conventional type. However, the invention can be adapted without difficulty to different compositions. In the usual manner, this unit 2 includes a drive plate 3 with a pipe 4 pivotally mounted about a pivot axis D.

This drive plate 3 carries a click 5. Click 5 includes a hook 6 with a beak 6A returned towards axis D by a spring 7.

Figure 19:
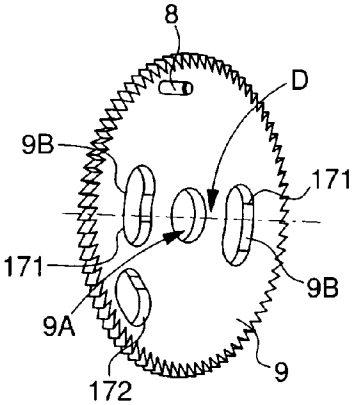
FIG. 19 shows a schematic, perspective view of the detent ratchet of the sub-assembly of FIG. 13.
Figure 15:
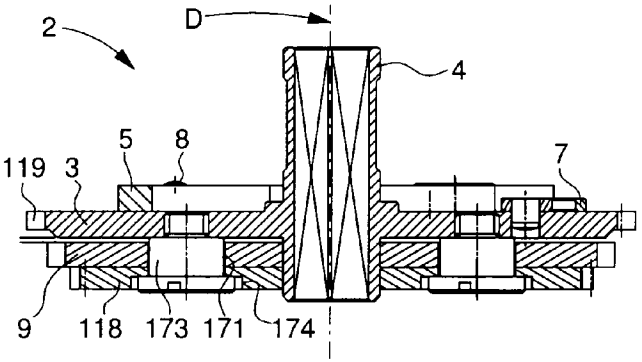
FIG. 15 shows a schematic, partial, cross-section of the sub-assembly of FIG. 3 along plane AA of FIG. 13.
Figure 18:
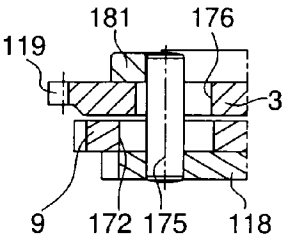
FIG. 18 shows a schematic, partial cross-section of the sub-assembly of FIG. 13 along plane CC of FIG. 14.
Figure 17:
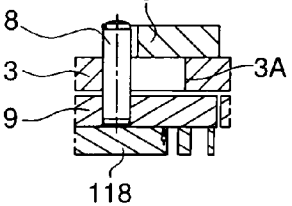
FIG. 17 shows a schematic, partial, cross-section of the sub-assembly of FIG. 13 along plane BB of FIG. 14.

Unit 2 includes a detent ratchet 9, which is arranged to cooperate with a striking mechanism control mechanism 10, in particular, in the case of FIG. 2, to be driven by click 109 of release lever 105. This detent ratchet 9, seen in FIG. 19, carries a pin 8, which can act, through a hole 3A in drive plate 3, on click 5. This click 5 is thus mobile, preferably substantially radially, against spring 7, i.e. towards the periphery of plate 3, by the action of this pin 8.

Figure 4:
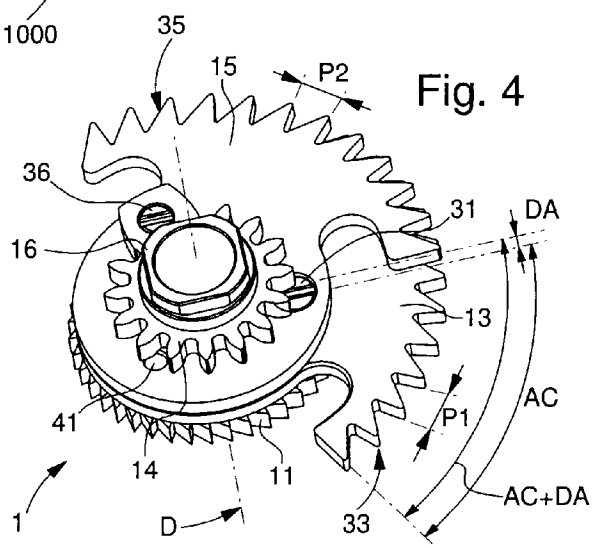
FIG. 4 shows a schematic, perspective view of a downstream stage of a striking mechanism unit according to the invention.
Figure 14A:
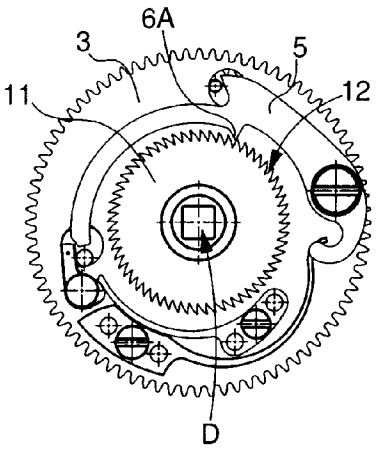
FIG. 14A shows a schematic, partial, simplified, plan view of the cooperation between the click beak and the detent ratchet.
Figure 14:
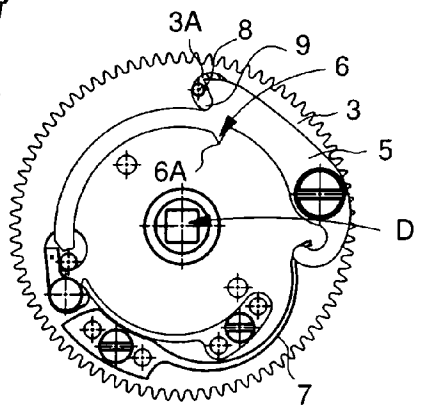
FIG. 14 shows a schematic, plan, top view of the sub-assembly of FIG. 13.
Figure 12:
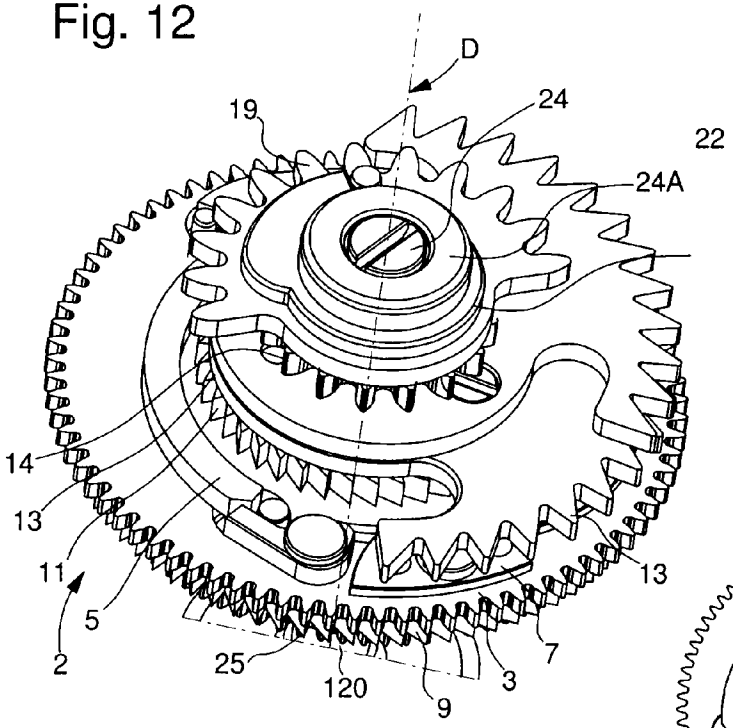
FIG. 12 is a partial view similar to FIG. 11 but seen from the opposite side.
Figure 16:
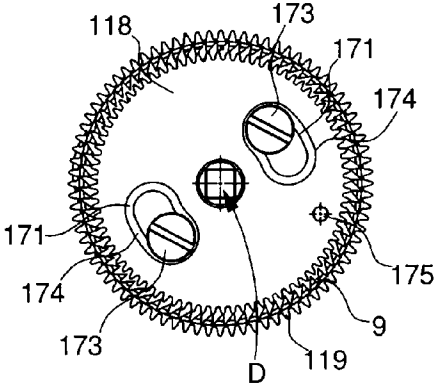
FIG. 16 shows a schematic, plan, bottom view of the sub-assembly of FIG. 13.
Figure 20:
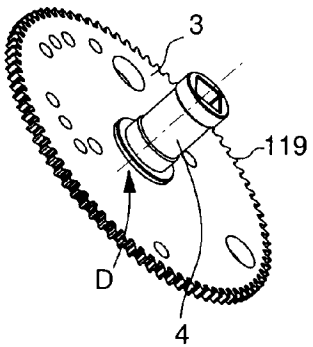
FIG. 20 shows a schematic, perspective view only of the drive plate of the sub-assembly of FIG. 13.

As seen in FIG. 4, downstream stage 1 includes a pipe ratchet 11, which is arranged to be pivotally mounted on pipe 4 of drive plate 3, about axis D. This pipe ratchet 11 is devised to cooperate, via a toothing 12 comprised therein, with the beak 6A of hook 6, as seen in FIG. 14A. Depending on its position, said beak 6A allows or prevents the pivoting of pipe ratchet 11.

This pipe ratchet 11 is mounted to pivot integrally about axis D with a first hour ratchet 13, which is arranged to cooperate with a first lifting piece 58 for driving a hammer comprised in this type of repeater striking mechanism 100.

The invention concerns more specifically a striking mechanism unit 2 for a timepiece repeater striking mechanism 100, said unit 2 including a drive plate 3 with a pipe 4 pivotally mounted about a pivot axis D, said drive plate 3 carrying a click 5 including a hook 6 provided with a beak 6A returned towards axis D by a spring 7. This unit 2 further includes a detent ratchet 9 pivoting about axis D and carrying a pin 8, which is in abutment, through a hole 3A in drive plate 3, on click 5 against spring 7 for operating hook 6 when detent ratchet 9 pivots. Depending on its position, said beak 6A of hook 6 allows or prevents the pivoting of a pipe ratchet 11 comprised in a downstream stage 1, said pipe ratchet 11 being mounted to pivot coaxially on pipe 4 and also to pivot integrally about axis D with a first hour ratchet 13.

According to the invention, this pivoting downstream stage 1 further includes at least a second hour ratchet 15, pivoting about axis D, the toothing of the second hour ratchet 15 being inclined in the same direction as the toothing of the first hour ratchet 13.

According to the invention, as seen in FIG. 4, downstream stage 1 further includes at least a second hour ratchet 15, which is arranged to be pivotally movable about axis D and to cooperate with a hammer lifting and drive piece comprised in this type of repeater striking mechanism 100. This hammer lifting and drive piece may be the same first lifting piece 58 but, preferably, it is a second hammer lifting and drive piece 56 belonging to the same striking mechanism 100.

The invention is described hereinafter for the preferred case of a single second hour ratchet. However, it is evident to those skilled in the art that if necessary the design can be extrapolated to a higher number of hour ratchets, to control actuation of different lifting pieces. Indeed, the principle of the invention, as it will be described hereinafter, is to allow distinct strikes or sounds to be produced according to different circumstances. The invention is described here for the case of a distinction between the morning and afternoon, or AM-PM, but may equally well be applied to other periods, which may or may not be of equal duration.

Preferably, this at least one second hour ratchet 15 is mounted to pivot integrally about axis D with the first hour ratchet 13. In a variant that is not described in detail here, the second ratchet 15 may have angular mobility to pivot about axis D relative to first ratchet 13, by combining an oblong hole with a pin, or similar.

Preferably, and as is shown in the Figures, the first hour ratchet 13 includes a toothing 33 on at least a first angular sector centred on axis D. The second hour ratchet 15 also includes a toothing 35 on at least a second angular sector centred on axis D. Advantageously, at least one part of the first angular sector, or the second angular sector respectively, is distinct from the second angular sector or first angular sector respectively, so as to allow the first hour ratchet 13 and said at least one second hour ratchet 15 to cooperate with distinct lifting pieces, and, in the particular case illustrated by the Figures, so as to allow said at least one second hour ratchet 15 to cooperate with a second lifting and drive piece 56, distinct from the first lifting and drive piece 58 with which the first hour ratchet 13 is arranged to cooperate.

Preferably, toothing 33 extends over at least a first angular sector centred on axis D, with triangular teeth, one side of which is directed towards pivot axis D, at a first angular pitch P1.

Similarly, the toothing 35 preferably extends over at least a second angular sector centred on axis D, with triangular teeth one side of which is directed towards pivot axis D, at a second angular pitch P2.

Preferably, as seen in FIG. 2, to allow hammers 108 and 106 to be moved apart, in order to limit the thickness of timepiece 1000, the corresponding lifting pieces 56 and 58 are set apart. Thus, preferably, toothing 33 of first ratchet 13 and toothing 35 of second ratchet 15 are angularly shifted by an angle at centre relative to axis D which is the sum of, on the one hand the value of the angle at centre AC formed relative to pivot axis D by the pivot axes about which the first lifting and drive piece 58 and the second lifting and drive piece 56 pivot, and, on the other hand an angular shift DA of lower value than the smallest between first angular pitch P1 and the second angular pitch P2, as seen in FIG. 4. This value DA may be zero, but the acoustic effect is better with a value allowing transmission of a sequenced or modulated sound which is clearly audible, for example with a value DA corresponding to a time difference on the order of a millisecond.

In a preferred configuration, seen in the Figures, the second angular pitch P2 is equal to the first angular pitch P1.

Figure 8:
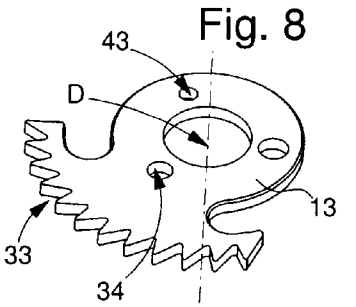
FIG. 8 shows a schematic, perspective view of a first hour ratchet comprised in the downstream stage of FIG. 4.
Figure 9:
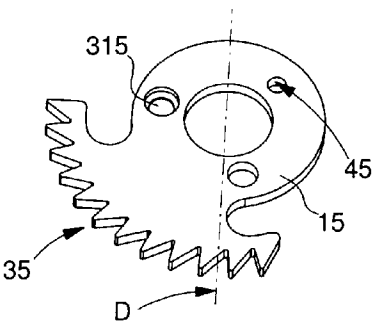
FIG. 9 shows a schematic, perspective view of a second hour ratchet comprised in the downstream stage of FIG. 4.
Figure 10:
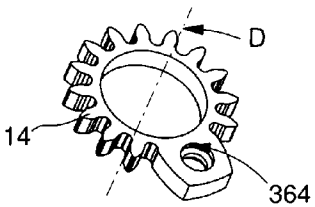
FIG. 10 shows a schematic, perspective view of a rack pinion comprised in the downstream stage of FIG. 4.

Preferably, the downstream stage 1 further includes a rack pinion 14, mounted to pivot integrally about axis D with the first hour ratchet 13, seen in FIG. 10 and arranged to cooperate with rack 115 comprised in this type of repeater striking mechanism 100.

The invention further concerns a striking mechanism unit 2 of this type for a repeater striking mechanism 100 including a drive plate 3 with a pipe 4 pivotally mounted about a pivot axis D, the drive plate 3 carrying a click 5 comprising a hook 6 with a beak 6A returned towards axis D by a spring 7, click 5 being mobile against spring 7 by the action of a pin 8 comprised in a detent ratchet 9 of unit 2 and which is arranged to cooperate with a striking mechanism control mechanism 10. According to the invention, this unit 2 includes at least one downstream stage 1 as described hereinbefore.

Preferably, the pipe 16 of pipe ratchet 11 includes a cylindrical shoulder 17 arranged to receive a pivotally movable quarter-rack pinion 19, which is comprised in unit 2 and seen in FIG. 3. This pinion 19 is arranged to cooperate with a quarter-rack 111 of a striking mechanism 100 of this type and carries a pin 21.

Striking mechanism unit 2 thus includes a quarter-rack pinion 19 pivotally movable on a pipe 16 comprised in pipe ratchet 11, said quarter-rack pinion 19 preferably carrying a pin 21. This pipe 16 includes a means 18 of pivoting a finger 22 comprised in unit 2, finger 22 being pivotally movable about axis D and including a bearing face 23 for cooperating with pin 21, to pivot unit 2 when the quarter-rack pinion 19 pivots in a single direction of pivoting able to drive finger 22.

This pipe 16 includes pivot drive means 18, for example, in the form of a Kelly bushing or similar, for a finger 22 comprised in unit 2. This finger 22, seen in FIG. 3, includes a bearing face 23, which is arranged to cooperate with pin 21, in order to drive pinion 19. Finger 22 is integral with or fixed to downstream stage 1 via the Kelly bushing thereof, and it allows pinion 19 to stop in a position which is set only by a quarter-rack 111. The angular shift between bearing face 23 and pin 8 thus increases according to the number of hours to be struck, before the striking mechanism starts.

The pipe 4 of drive plate 3 preferably includes pivot drive means for example in the form of a Kelly bushing or similar, arranged to cooperate with drive arbour 120 of repeater striking mechanism 100.

Drive plate 3 includes a hole 3A for the passage of pin 8 of detent ratchet 9 for operating hook 6, by the action of a striking mechanism control mechanism 10 or a release lever 105 or a click 109 of a lever 105 of this type, comprised in a repeater striking mechanism 100 of this type.

FIGS. 13 to 19 illustrate the detailed assembly of the bottom sub-assembly of striking mechanism unit 2, which is intended to carry downstream stage 1. FIGS. 15 to 18 illustrate a particular variant, wherein detent ratchet 9 is juxtaposed with an independent wheel 118 used for other functions of striking mechanism 100, each being able to act on hook 5 via a pin, but never at the same time. This particular variant also includes a drive plate 3 with a peripheral toothing 119 for other applications.

The mechanism according to the invention can be used for a minute repeater, or for a grand strike, as shown in the Figures. In the particular case of a grand strike, timepiece movement 200 drives snails 101, 102 and 103, which supply an exact time reference at any time. Whether it occurs automatically or manually, the release of the striking mechanism causes the action of first click 109 of release lever 105 on detent ratchet 9, causing said ratchet to pivot. Consequently, the pin 8 carried by said ratchet 9 moves in hole 3A in drive plate 3, and pushes hook 6 thus releasing toothing 12 of pipe ratchet 11, which, in the rest position of spring 7, was meshed with beak 6A of hook 6. The downstream stage 1 can then pivot freely about axis D. By the action of springs which cooperate with quarter-rack 111 and minute-rack 110, downstream stage 1 is pivoted by the action of rack pinion 14, which is permanently driven by rack 115 until a rack arm stops on the hour snail 101. The spring of quarter-rack 111 drives the quarter-rack pinion 19 until an arm of quarter-rack 111 is stopped on quarter snail 102. The arm of minute-rack 110 is positioned on minute snail 103 in a conventional manner, via the movement of the quarter-rack 111. When the striking mechanism is set in motion, pin 8 is released, and spring 7 couples downstream stage 1 again, via toothing 12 of pipe ratchet 11, which is meshed on beak 6A of hook 6, which activates the various lifting pieces on the respective hammers.

The invention also concerns a repeater striking mechanism 100 including a striking mechanism unit 2 of this type. According to the invention, the repeater striking mechanism also includes, on the one hand, a first lifting piece 58 driving a first hammer 108 cooperating with the first hour ratchet 13, and, on the other hand, a second lifting piece 56 driving a second hammer 106 distinct from the first lifting and drive piece 58 and cooperating with said at least one second hour ratchet 15, and it comprises a striking mechanism control mechanism 10 which controls the pivoting of striking mechanism unit 2 by operating hook 6.

This repeater striking mechanism 100 includes a drive arbour 120 pivotally mounted about a pivot axis D, and on which a striking mechanism unit 2 is fitted, for controlling a first lifting piece 58 and a second lifting piece 56 comprised in striking mechanism 100, to actuate at least one hammer 108. The striking mechanism 100 includes a main striking mechanism control mechanism 10 and/or a release lever 105, and/or a click 109 of a said lever 105, which is arranged to control the pivoting of striking mechanism unit 2. In a preferred embodiment, the striking mechanism control mechanism 10 includes a release lever 105 controlling the pivoting of striking mechanism unit 2, either directly, or via a click 109 comprised in said lever 105.

Striking mechanism 100 includes at least a first hammer 108 arranged to be actuated by the first lifting piece 58 and preferably at least a second hammer 106 arranged to be actuated by the second lifting piece 56.

Figure 21:
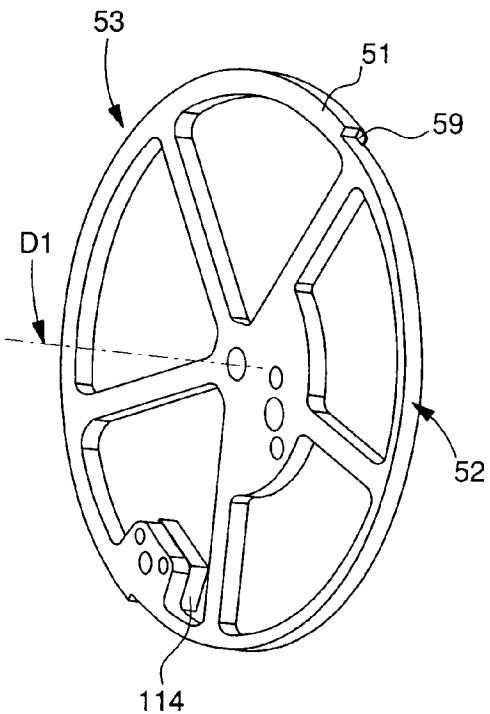
FIG. 21 shows a schematic, perspective view of a period reference cam comprised in the repeater striking mechanism of FIG. 2.

According to an advantageous feature of the invention, the striking mechanism 100 includes a cam 51, seen in FIG. 21, and which is arranged to give the striking mechanism 100 information that differentiates between a first period and a second period, to operate, during the first period or second period respectively, only one of the first 13 or second 15 hour ratchets, and to operate, during the second period or first period respectively, either the other of the first 13 or second 15 hour ratchets, or both of the first 13 and second 15 hour ratchets at the same time.

Figure 22:
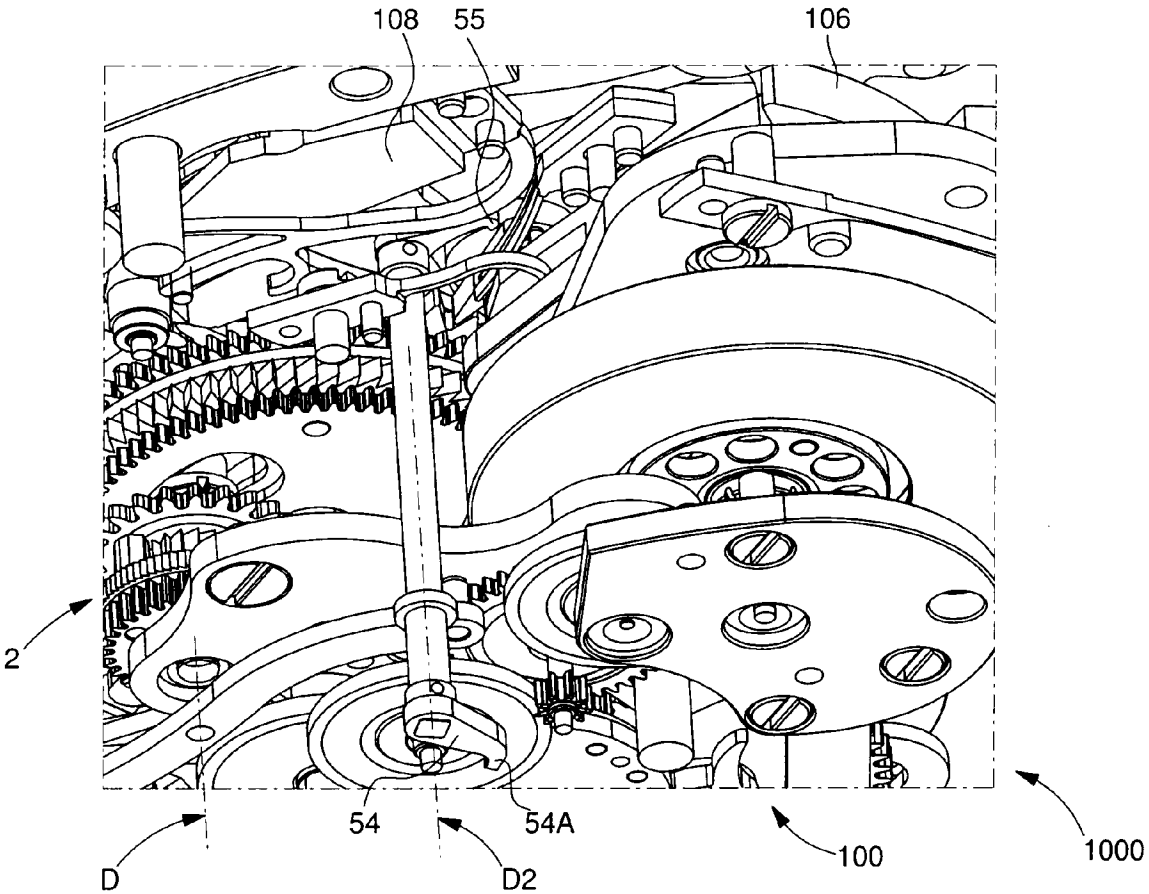
FIG. 22 shows a schematic, partial and perspective view of a detail of the repeater striking mechanism of FIG. 2 comprising a feeler spindle intended to cooperate with the cam of FIG. 21.

As seen in FIG. 21, cam 51 pivoting about an axis D1, includes a first path 52 corresponding to the first period and a second path 53 corresponding to the second period, which are travelled in succession by a finger 54A, seen in FIG. 22, comprised in a pivoting feeler spindle 54. This feeler spindle 54 pivoting about an axis D2, preferably parallel to axis D1, which is preferably parallel to axis D, includes a beak 55. This beak 55 is arranged to cooperate with a lifting piece beak 57 comprised in the second lifting piece 56 to hook the lifting piece beak 57 so as to lock said lifting piece, as seen in FIG. 24, when finger 54A travels the path corresponding to the first period, or second period respectively, and to allow the lifting piece beak 57 to pass and the second lifting piece 56 to pivot, as seen in FIG. 23 when finger 54A travels the path corresponding to the second period, or first period respectively.

In a particular application, the first period is the morning and the second period is the afternoon, or vice versa. Cam 51 is then a 24 hour cam, located underneath the striking mechanism, driven by the hour wheel in a gear ratio of 1/2. The cam completes one revolution in 24 hours.

This cam 51 is shown in FIG. 21 with a spring 59 for ensuring hold while the finger 54A of feeler spindle 54 rises from path 52 onto path 53. Thus beak 55 of feeler spindle 54 is prevented from floating in relation to beak 57 of lifting piece 56 during this abrupt upward movement.

Cam 51 further includes a release finger 114 for a date mechanism.

The second lifting and drive piece 56 is arranged to drive the first hammer 108 and/or a second hammer 106. Preferably, as illustrated in the Figures, it drives only second hammer 106.

In this preferred but non limiting application of striking mechanisms that differentiate between morning and afternoon, when finger 54A reads the path corresponding to the morning, lifting piece 56 is locked, via the beak 57 thereof, by beak 55 of finger 55 of feeler spindle 54. This lifting piece 56 cannot, therefore, tip in the morning, which prevents the second hammer 106 from operating in the morning. The striking mechanism is thus played, in a conventional manner, with a single hammer on a single gong or similar.

In the afternoon, feeler spindle 54 releases, via beak 55, beak 57 of lifting piece 56, which can therefore pivot freely. When the striking mechanism control mechanism 10 acts on striking mechanism unit 2 and starts the pivoting of downstream stage 1, ratchets 13 and 15 respectively actuate lifting pieces 58 and 56, which starts the operation of hammers 108 and 106. It would be possible for the lifting pieces to act on a single gong, but the resonance effects may prove acoustically unpleasant, and it is preferable, and more gratifying for the user, to strike separate gongs with the two hammers 108 and 106. If the angular shift DA is zero, the strike is synchronous. If shift DA is not zero, a more pleasant effect is produced, in the form of a sound extended by modulation, like the overlapping notes of the baroque lute or harpsichord pieces.

It will be noted that if, by design, the ratchet 13 and ratchet 15 are angularly mobile in unit 1, and if a position locking means is provided, the watchmaker can adjust a particular shift DA as desired by the client.

Preferably, in striking mechanism 100, the pivot axes about which the first lifting and drive piece 58 and second lifting and drive piece 56 pivot form an angle at centre AC relative to axis D, and the first hour ratchet 13 has a toothing 33 at a first angular pitch P1 on at least a first angular sector centred on axis D, the second hour ratchet 15 includes a toothing 35 at a second angular pitch P2 on at least a second angular sector centred on axis D, and toothing 33 and toothing 35 are angularly shifted by an angle at centre relative to axis D which is the sum of, on the one hand, the value of the angle at centre AC, and on the other hand, an angular shift DA of lower value than the smallest between first angular pitch P1 and the angular pitch P2.

The invention further concerns a timepiece 1000 including at least one timepiece movement 200 and at least one striking mechanism 100, the timepiece movement 200 being arranged to control the striking mechanism 100.

The invention allows distinct striking mechanisms/strikes to be created without any significant modification of the existing repeater striking mechanisms.

It is also possible to use a plurality of cams, or cams with a plurality of paths. In particular, by coupling a time zone push piece with the release of the striking mechanism on demand, it is possible to select a cam peculiar to the time zone concerned. By using hammers and gongs dedicated to the second time zone it is easy to distinguish which time is being displayed by the striking mechanism. This time zone application could evidently be coupled with the AM-PM application described here, or even with a day-night or other application, since there is no limit to the use of the invention. For example, the time of sunrise in the northern or southern hemisphere could be struck by creating a suitable application.

Returning to the example of the AM-PM application described here, in a variant of the invention, the cam can also be used to start the uncoupling of lifting piece 58. In such case, the striking mechanism plays the morning on one gong and the afternoon on a different gong.

What is claimed is:

1. A striking mechanism unit for a timepiece repeater striking mechanism, said unit including a drive plate with a pipe pivotally mounted about a pivot axis, said drive plate carrying a click including a hook provided with a beak returned towards said axis by a spring wherein said unit further includes a detent ratchet pivoting about said axis and carrying a pin which is in abutment, through a hole in said drive plate, on said click against said spring to operate said hook when said detent ratchet pivots, and said beak of said hook, depending on the position thereof, allows or prevents the pivoting of a pipe ratchet, comprised in a downstream stage, said pipe ratchet being mounted to pivot coaxially on said pipe and also to pivot integrally about said axis with a first hour ratchet, wherein said pivoting downstream stage further includes at least a second hour ratchet pivoting about said axis, the toothing of said second hour ratchet being inclined in the same direction as the toothing of said first hour ratchet.

2. The striking mechanism unit according to the claim 1, wherein at least one said second hour ratchet is mounted to pivot integrally about said axis with said first hour ratchet.

3. The striking mechanism unit according to claim 1, wherein said first hour ratchet includes a toothing on at least a first angular sector centred on said axis, wherein said second hour ratchet includes a toothing on at least a second angular sector centred on said axis, and wherein at least one part of said first angular sector, or said second angular sector respectively, is distinct from said second angular sector or said first angular sector respectively, so as to allow said first hour ratchet and said at least one second hour ratchet to cooperate with separate lifting pieces.

4. The striking mechanism unit according to claim 1, wherein said first hour ratchet includes a toothing on at least a first angular sector centred on said axis, with triangular teeth, one side of which points towards said pivot axis at a first angular pitch.

5. The striking mechanism unit according to claim 4, wherein said second hour ratchet includes a toothing on at least a second angular sector centred on said axis, with triangular teeth, one side of which points towards said pivot axis, at a second angular pitch.

6. The striking mechanism unit according to claim 5, wherein said second angular pitch is equal to said first angular pitch.

7. The striking mechanism unit according to claim 1, wherein it further includes a rack pinion, mounted to pivot integrally about said axis with said first hour ratchet.

8. The striking mechanism unit according to claim 1, wherein it includes a quarter-rack pinion which is pivotally movable on a pipe comprised in said pipe ratchet, said quarter-rack pinion carrying a pin, and wherein said pipe includes a means of pivoting a finger comprised in said unit, said finger being pivotally movable about said axis and including a bearing surface for cooperating with said pin to pivot said unit when said quarter-rack pinion pivots in a single direction of pivoting capable of driving said finger.

9. A repeater striking mechanism including a striking mechanism unit according to claim 1, wherein it further includes, on the one hand, a first lifting piece for driving a first hammer cooperating with said first hour ratchet and, on the other hand, a second lifting piece for driving a second hammer, distinct from said first lifting and drive piece and cooperating with said at least one second hour ratchet and wherein it includes a striking mechanism control mechanism which controls the pivoting of said striking mechanism unit by operating said hook.

10. The repeater striking mechanism according to the claim 9, wherein it includes a drive arbour pivotally mounted about a pivot axis and onto which said striking mechanism unit is fitted for controlling said first lifting piece and said second lifting piece.

11. The repeater striking mechanism according to claim 9, wherein striking mechanism control mechanism includes a release lever which controls the pivoting of said striking mechanism unit, either directly or via a click comprised in said lever.

12. The striking mechanism unit according to claim 3, wherein said toothing of said first hour ratchet and said toothing of said second hour ratchet are angularly shifted by an angle at centre relative to said axis which is the sum, on the one hand, of the value of the angle at centre formed relative to said axis by pivot axes about which said first lifting and drive piece and said second lifting and drive piece pivot, and on the other hand, an angular shift of lower value than the smallest between said first angular pitch and second angular pitch.

13. The repeater striking mechanism according to claim 9, wherein it includes a rack for driving a rack pinion mounted to pivot integrally about said axis with said first hour ratchet.

14. The repeater striking mechanism according to claim 9, wherein it includes a quarter-rack for driving a quarter-rack pinion which is pivotally movable on a pipe comprised in said pipe ratchet, said quarter-rack pinion carrying a pin, and wherein said pipe includes a means of pivoting a finger comprised in said unit, said finger being pivotally movable about said axis and including a bearing surface for said pin, for pivoting said striking mechanism unit when said quarter-rack pivots in a single direction of pivoting capable of driving said finger.

15. The repeater striking mechanism according to claim 9, wherein it includes a cam which provides said striking mechanism with information differentiating between a first period and a second period, for operating, during said first period, or said second period respectively, a single one of said first or second hour ratchets, and for operating during said second period, or said first period respectively, either the other of said first or second hour ratchets, or both of said first and second hour ratchets.

16. The repeater striking mechanism according to claim 15, wherein said cam includes at least a first path corresponding to said first period and at least a second path corresponding to said second period, which are respectively traveled by a finger comprised in a feeler spindle including a beak cooperating with a lifting piece lever comprised in said second lifting piece in order to hook said lifting piece lever so as to lock said lifting piece when said finger travels the path corresponding to said first period or said second period respectively, and to allow said lifting piece lever to pass and said second lifting piece to pivot when said finger travels the path corresponding to said second period or said first period respectively.

17. The striking mechanism according to claim 16, wherein said cam is a 24 hour cam, and wherein said first period is the morning and said second period is the afternoon, or vice versa.

18. The striking mechanism according to claim 9, wherein said second lifting piece drives said first hammer and/or said second hammer.

19. A timepiece including at least one timepiece movement and at least one striking mechanism according to claim 9, said timepiece movement controlling said striking mechanism.

* * * * *